US007172499B2

(12) United States Patent
Eklund

(10) Patent No.: US 7,172,499 B2
(45) Date of Patent: Feb. 6, 2007

(54) TOOL FOR POLISHING THE EDGE OF A KNIFE

(76) Inventor: Tore Eklund, Larstorpsvägen 13, SE-591 70 Motala (SE)

( * ) Notice: Subject to any disclaimer, the term of this patent is extended or adjusted under 35 U.S.C. 154(b) by 0 days.

(21) Appl. No.: 10/530,029

(22) PCT Filed: Sep. 29, 2003

(86) PCT No.: PCT/SE03/01507

§ 371 (c)(1),
(2), (4) Date: Nov. 16, 2005

(87) PCT Pub. No.: WO2004/030861

PCT Pub. Date: Apr. 15, 2004

(65) Prior Publication Data

US 2006/0128285 A1 Jun. 15, 2006

(30) Foreign Application Priority Data

Oct. 1, 2002 (SE) ..... 0202887

(51) Int. Cl.
*B24B 3/54* (2006.01)

(52) U.S. Cl. ..... 451/261; 451/349; 76/86

(58) Field of Classification Search ..... 451/192, 451/193, 198, 203, 261, 262, 45, 486, 349, 451/358, 359; 76/82, 86, 87, 89
See application file for complete search history.

(56) References Cited

U.S. PATENT DOCUMENTS

| | | | | |
|---|---|---|---|---|
| 989,692 | A | 4/1911 | Brower et al. | |
| 2,598,589 | A * | 5/1952 | Murchison | 451/555 |
| 2,646,653 | A | 7/1953 | Murchison | |
| 4,672,778 | A | 6/1987 | Rieser | |

FOREIGN PATENT DOCUMENTS

| | | |
|---|---|---|
| CN | 502162 | 3/1971 |
| DE | 582357 | 8/1933 |
| DE | 4341872 | 6/1995 |
| DE | 10044614 | 5/2001 |
| FR | 1171230 | 1/1959 |
| WO | WO 9911428 | 3/1999 |

* cited by examiner

*Primary Examiner*—Robert A. Rose
(74) *Attorney, Agent, or Firm*—Young & Thompson

(57) ABSTRACT

A tool for polishing knife's edges, the tool (1) comprising two oppositely positioned and co-rotating rings of elongate honing studs (10), extended at intersecting directions forming an angle (α) wherein the knife's edge is inserted to be straightened by the rotating polishing tool.

20 Claims, 1 Drawing Sheet

TOOL FOR POLISHING THE EDGE OF A KNIFE

TECHNICAL FIELD

Figure 2:
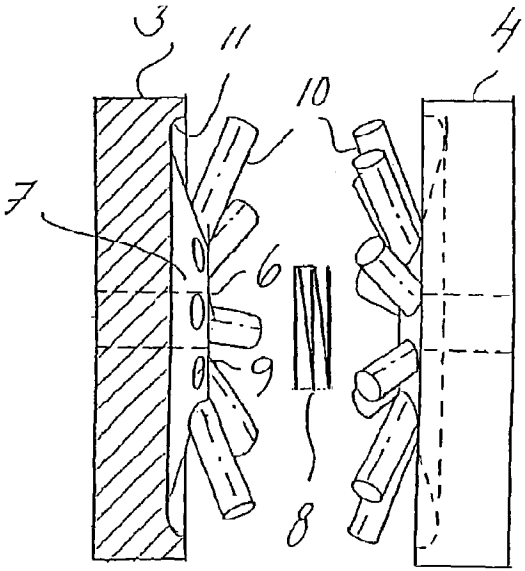

The present invention relates to a tool for polishing the edge of a knife, and more specifically to a driven, rotary tool for straightening a knife's edge in accordance with the preamble of claim 1.

TECHNICAL BACKGROUND AND PRIOR ART

In this context, polishing refers to a step that is performed in connection with the straightening of a knife's edge, comprising an operation to zero in the outermost, comparatively thin edge of a sharpened knife blade by the use of a smooth steel tool. This step is normally performed manually by repeatedly moving the knife's edge along a straight and smooth steel tool in a cutting motion, towards and away from the operator, such that both sides of the knife is alternately brought into contact with the steel tool, while ensuring that the knife's contact angle with the steel tool is accurate and the same for both sides of the knife being polished. If the knife is applied at an angle that is incorrect, or too large, there is a significant risk of bending the edge from one side to the other, eventually resulting to a broken edge. Naturally, the manual procedure leads to varying results and requires a certain amount of skill to be acquired, in order to repeatedly achieve satisfying results.

A sharpening apparatus is known from U.S. Pat. No. 5,478,272, comprising arcuate steel members supported in one end to pivot from a base member. The steel bars are biased, and crossing each other in front of a slot formed in the base member. The knife's edge is pressed manually towards the steel members and pulled lengthwise through the slot, while forcing the point of intersection between the steel members always to contact the knife's edge, independently of the contact pressure from the knife. The apparatus is stationary and arranged to be fastened onto a work surface.

A knife in use is subjected to mechanical forces that effect the straightness of the knife's edge and thus reduces the effectiveness of the knife. For this reason, the knife's edge is normally straightened several times between successive operations for sharpening the edge. Thus, the manual polishing procedure may be seen as time consuming and labor-intensive, requiring repeated movements of the arms in frequent polishing operations.

The present invention aims to improve prior methods by providing a polishing tool that leads to repeatable results without requiring special skills to be acquired by the operator, and more specifically with respect to the contact angle between polishing tool and the two sides of the knife blade.

Another object is to provide a time- and laborsaving polishing tool of high capacity.

These and other objects are met in a tool according to the features and characterizing portion of claim 1. Embodiments are specified in subordinated claims.

According to the invention there is provides a polishing tool driven for rotation. The polishing tool comprises two oppositely positioned and co-rotating rings of elongate honing studs, extended at intersecting directions forming an angle ($\alpha$) wherein the knife's edge is inserted to be straightened by the rotating polishing tool.

SHORT DESCRIPTION OF THE DRAWINGS

Figure 1:
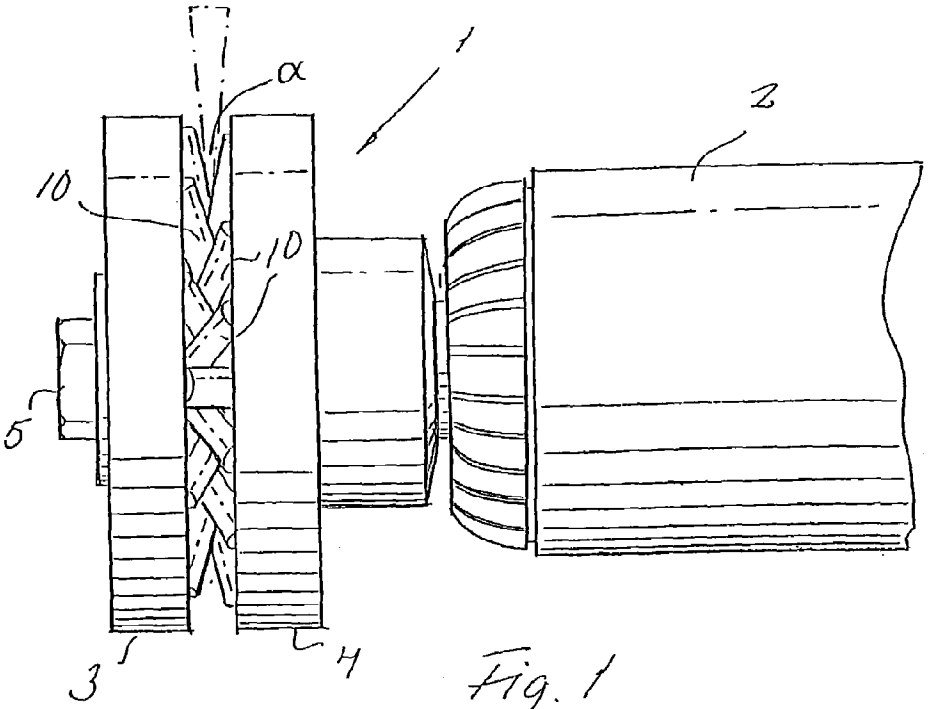

The invention is more closely explained below, reference being made to the accompanying drawings wherein FIG. 1 shows a side view of a hand held device and polishing tool in mounted position, and FIG. 2 shows the separate polishing tool in a partially sectioned side view.

DETAILED DESCRIPTION OF EMBODIMENTS

Referring to FIGS. 1–2, an embodiment of the invention is shown to comprise a polishing tool 1, more closely explained below, and arranged to be driven for rotation. The polishing tool 1 comprises two oppositely positioned and co-rotating rings of honing studs (10), extended at intersecting directions that form an angle ($\alpha$) wherein a knife's edge is inserted to be straightened by the rotating studs of the polishing tool. The polishing tool may be stationary mounted or carried by a hand held drive means, and electrically, pneumatically or hydraulically driven.

In a preferred embodiment the polishing tool 1 has two rotationally symmetric bodies (3,4), the bodies being substantially identically shaped and coupled axially by means of a through bolt 5. In a mounted position, the bolt 5 may be dimensioned to reach through the bodies 3,4 for engagement with a fixture or chucking device in order to connect the polishing tool 1, non-rotationally, with the drive shaft of a hand held electric motor 2. Preferably, the bodies 3,4 are rotationally symmetric and driven to rotate at a rotation speed that provides a peripheral speed which is suitable for polishing.

A hub 6 arises from a center portion of each body 3,4, the hub having a sloping wall 7 connecting the top of the projecting hub with the front end of the body 3,4, radially outside the hub. In the mounted position, the bodies are positioned with front ends and hubs 6 facing each other, either directly in contact or through an intermediate elastic element 8. Each hub 6 comprises a number of blind bores 9 evenly spaced on a circular line about the sloping wall 7. The bores 9 extend in radial direction towards the periphery of the body 3,4, and sloping with respect to a sectional plane cutting transversely through a central axis of the body. The hub 6 further comprises a central through hole (broken lines in FIG. 2) for the bolt 5, and may have a recess cut down from the top surface for accommodation of the elastic element 8, such as a coil spring 8.

A honing stud 10 having a smooth periphery is inserted, by its inner end, in each blind bore 9. In the shown embodiment the honing stud 10 is bolt-shaped, having a circular cross section, and is produced from a material having a hardness greater than the hardness of a knife's blade. For example, the honing stud 10 may be produced in metal or metal alloy, ceramic material or glass. Alternatively, the honing stud may be composed from a core surrounded by a layer of other material, and subjected to hardening processes or surface hardening, as appropriate. The term "honing stud", as used in this description, should be interpreted by its functional use for polishing knife's edges without limitation to materials from which the stud is composed and produced.

The honing stud 10 generally has an elongate shape and an axial length which is determined such that a free, radially outer end of the stud terminates within the perimeter of the opposite body 3 or 4, respectively. An endless, circular groove or recess 11 is formed in this same end of the body 3,4, the circular groove 11 receiving and supporting the free ends of the honing studs 10 of the opposite body when the bodies are coupled to form the polishing tool 1. This way, the honing studs are prevented from being dislodged by centrifugal forces arising as the tool is rotated, and a replacement of the honing studs is also simplified. Alternatively, the reception of the outer end of the studs may have a shape other than the suggested groove 11, and may for example be provided as separate pits or a ring shaped projection, etc.

An alternative embodiment (not shown in the drawings) foresees that the honing studs 10 are attached radially within the perimeter of the supporting bodies, respectively, to be supported by their inner ends in recesses formed in a central portion of the opposite body, or in the wall 7.

The diameter of the honing studs 10, and angular distances between the evenly spaced bores 9 arranged on a circular line, preferably is related such that the studs are brought in contact with each other, thereby blocking the bodies 3,4 and preventing relative rotation of the bodies in the coupled position, wherein the honing studs 10 of one body 3,4 intersects with the honing studs 10 of the opposite body 4,3.

The slope angle of the bores 9, deciding the relative slope and intermediate angle $\alpha$ between the intersecting honing studs, is determined for straightening the edge of a knife's blade (see the broken lines in FIG. 1) that is inserted in the angular space and applied to contact the studs. The angle $\alpha$ may, for example, be in the range of 20–50°, advantageously between 25° and 45°. Apparently, the intermediate angle $\alpha$ between intersecting studs remains the same also if the bodies are urged towards each other in axial movement, against the force of the intermediate elastic element 8, when sufficient load is applied from the knife's blade.

Significantly, the operation of a rotary polishing tool according to this invention is characterized by a gradual and smooth shaping of the knife's edge. This may be referred to the effect of the points of intersection between the rotating honing studs, that is the apex of the intermediate angle $\alpha$, gradually approaching the knife's edge that is applied tangentially to the circular path of rotation of these points of intersection. In other words, the knife's edge is brought in contact with the honing studs at an intersecting angle $\alpha$, only at that moment, when the contact points on the arcuate surfaces of the studs passes a line perpendicular from the knife's edge, and through the center of rotation of the polishing tool. Before and after that moment or that perpendicular line (as seen in the direction of rotation), the knife's edge is located at a longer radial distance from the center of rotation, and radially outwardly of the apex of the intersecting angle. Thus, the distance between intersecting honing studs as measured transversely to the knife's edge is constantly decreasing towards the perpendicular, wherein the knife's edge passes the apex of the intersecting angle. This relation is used in the invention for straightening, smoothly, any such deformation referring to a departure from a linear extension of the knife's edge, by gradually increasing the contact pressure applied from the rotating honing studs.

The invention may be realized in various embodiments. For example, two rings of intersecting honing studs may be extended at an intersecting angle from a common rotating body, wherein the inner ends of the studs are supported by, e.g., a threaded attachment. Other variants may comprise honing studs formed as protrusions and integrally formed in sloping front ends of two opposite, identical bodies driven for rotation, such that a supplementary recess between adjacent studs/protrusions is effective for receiving the studs of the opposite body when the bodies are coupled and angularly displaced, substantially as a pair of interacting bevel gears overlapping in a central portion of the gears. Further, the honing studs may be of other sectional profiles than the one described above, such as elliptic, super elliptic, oval, round, circular, or with a partially circular or rounded surface sweeping the knife's edge. Also, the honing studs may have a continuous sectional profile through the whole length of the stud, or be conically tapered towards or from the center of rotation. The accompanying claims include all such variations to the invention that will be understood by a man skilled in the art from reading the above description.

The invention claimed is:

1. A tool (1) for polishing a knife's edge, the tool comprising two substantially identical bodies (3,4) carried on a rotary shaft of a hand held motor (2), said bodies having front ends facing each other in direct contact or through an intermediate elastic element (8), and further comprising two co-rotating rings of honing studs (10) facing each other, the honing studs extended between the bodies (3,4) at intersecting directions forming an intermediate angle wherein the knife's edge is inserted to be straightened by the tool in rotation, wherein a radially inner end of each honing stud (10) is supported from a central portion (6) in the front end of one body (3,4), and an outer end is received and supported within the perimeter of the front end of the opposite body (3,4), when the bodies are mounted on the rotary shaft.

2. The tool of claim 1, characterized in that the inner ends of the honing studs (10) are inserted in blind bores (9) that are evenly spaced on a circular line about a hub (6), arising from a center portion in the front end of each body (3,4), the blind bores sloping radially towards the perimeter of the body, and a formation (11) arranged within said perimeter receiving the outer ends of the honing studs from the opposite body when the bodies are mounted on the rotary shaft, thereby preventing the honing studs from being dislodged due to centrifugal forces arising during rotation of the polishing tool.

3. The tool of claim 2, further comprising an elastic element (8) between the bodies (3,4), by which the bodies are axially movable towards each other on the shaft against the force of the elastic element (8).

4. The tool of claim 1, characterized by each body (3,4) being formed with a hub (6) arising above the front end and having a central through hole, a sloping wall (7) connecting the top of the hub to a radially outer portion of the front end, and a formation (11) arranged in the front end within the perimeter of the body, the formation being a ring-shaped groove, a number of pits, or a protrusion, and blind bores (9) receiving the inner ends of the honing studs (10) arranged on a circle running about the sloping wall (7).

5. The tool of claim 1, wherein the bodies (3,4) are prevented from relative rotation through the honing studs (10) intersecting under mutual contact when the bodies are mounted on the shaft.

6. The tool of claim 1, wherein the honing studs (10) having an oval, or an elliptic, or a circular sectional profile at least in a portion of the surface that sweeps the knife's edge.

7. The tool of claim 1, wherein the honing studs (10) are produced from a ceramic material, from metal, or from glass.

8. The tool of claim 7, wherein the honing studs (10) are composed from a core surrounded by a layer of other material than the core.

9. The tool of claim 1, wherein the intermediate angle between intersecting honing studs is 20–500°.

10. The tool of claim 2, characterized by each body (3,4) being formed with a hub (6) arising above the front end and having a central through hole, a sloping wall (7) connecting the top of the hub to a radially outer portion of the front end, and a formation (11) arranged in the front end within the perimeter of the body, the formation being a ring-shaped groove, a number of pits, or a protrusion, and blind bores (9) receiving the inner ends of the honing studs (10) arranged on a circle running about the sloping wall (7).

11. The tool of claim 3, characterized by each body (3,4) being formed with a hub (6) arising above the front end and having a central through hole, a sloping wall (7) connecting the top of the hub to a radially outer portion of the front end, and a formation (11) arranged in the front end within the perimeter of the body, the formation being a ring-shaped groove, a number of pits, or a protrusion, and blind bores (9) receiving the inner ends of the honing studs (10) arranged on a circle running about the sloping wall (7).

12. The tool of claim 2, wherein the bodies (3,4) are prevented from relative rotation through the honing studs (10) intersecting under mutual contact when the bodies are mounted on the shaft.

13. The tool of claim 3, wherein the bodies (3,4) are prevented from relative rotation through the honing studs (10) intersecting under mutual contact when the bodies are mounted on the shaft.

14. The tool of claim 4, wherein the bodies (3,4) are prevented from relative rotation through the honing studs (10) intersecting under mutual contact when the bodies are mounted on the shaft.

15. The tool of claim 2, wherein the honing studs (10) having an oval, or an elliptic, or a circular sectional profile at least in a portion of the surface that sweeps the knife's edge.

16. The tool of claim 3, wherein the honing studs (10) having an oval, or an elliptic, or a circular sectional profile at least in a portion of the surface that sweeps the knife's edge.

17. The tool of claim 4, wherein the honing studs (10) having an oval, or an elliptic, or a circular sectional profile at least in a portion of the surface that sweeps the knife's edge.

18. The tool of claim 5, wherein the honing studs (10) having an oval, or an elliptic, or a circular sectional profile at least in a portion of the surface that sweeps the knife's edge.

19. The tool of claim 2, wherein the honing studs (10) are produced from a ceramic material, from metal, or from glass.

20. The tool of claim 3, wherein the honing studs (10) are produced from a ceramic material, from metal, or from glass.

* * * * *